US010126093B2

(12) United States Patent
Willson

(10) Patent No.: US 10,126,093 B2
(45) Date of Patent: Nov. 13, 2018

(54) STOCK FOR LAUNCHER

(71) Applicant: United Tactical Systems, LLC, Lake Forest, IL (US)

(72) Inventor: Jonathan Schoen Willson, Cecil, OH (US)

(73) Assignee: United Tactical Systems, LLC, Lake Forest, IL (US)

( * ) Notice: Subject to any disclaimer, the term of this patent is extended or adjusted under 35 U.S.C. 154(b) by 0 days.

(21) Appl. No.: 15/872,400

(22) Filed: Jan. 16, 2018

(65) Prior Publication Data

US 2018/0202753 A1 Jul. 19, 2018

Related U.S. Application Data

(60) Provisional application No. 62/446,748, filed on Jan. 16, 2017.

(51) Int. Cl.

| | |
|---|---|
| ***F41B 11/00*** | (2013.01) |
| ***F41B 11/70*** | (2013.01) |
| ***F41B 11/62*** | (2013.01) |
| ***F41B 11/55*** | (2013.01) |
| ***F41C 23/14*** | (2006.01) |

(52) U.S. Cl.

CPC ..... *F41B 11/70* (2013.01); *F41B 11/00* (2013.01); *F41B 11/55* (2013.01); *F41B 11/62* (2013.01); *F41C 23/14* (2013.01)

(58) Field of Classification Search

CPC ..... F41B 11/00; F41B 11/62; F41B 11/70

See application file for complete search history.

(56) References Cited

U.S. PATENT DOCUMENTS

| | | | | |
|---|---|---|---|---|
| 7,107,981 | B1 * | 9/2006 | Dunn | F41B 11/62 124/74 |
| 7,850,036 | B2 * | 12/2010 | Cirone | F41B 11/62 124/74 |
| 9,696,109 | B2 * | 7/2017 | Harvey | F41B 11/72 |
| 2017/0299321 | A1 * | 10/2017 | Lort | F41B 11/642 |

* cited by examiner

*Primary Examiner* — John Ricci

(74) *Attorney, Agent, or Firm* — Barnes & Thornburg LLP

(57) ABSTRACT

A quick release stock assembly for a launcher is provided having a stock bar and a stock housing. The stock bar has a first end and a second end, the first end having a mating member that secures the stock bar to the launcher in a first orientation and that precludes the stock bar from being removed from the launcher in the first orientation. The stock bar is removable from the launcher in a second orientation. The stock housing has a cavity sized to receive a pressurized canister, and a receiver to slidingly receive the stock bar about its length. The stock housing further has a release pin transverse to the receiver to engage the stock bar and longitudinally fix the stock bar in the stock housing in a plurality of positions.

20 Claims, 6 Drawing Sheets

STOCK FOR LAUNCHER

CROSS-REFERENCE TO RELATED APPLICATIONS

This application claims the benefit of U.S. Provisional Patent Application No. 62/446,748, filed Jan. 16, 2017, which is expressly incorporated herein by reference and made a part hereof.

FEDERALLY SPONSORED RESEARCH OR DEVELOPMENT

Not Applicable.

TECHNICAL FIELD

The present disclosure relates generally to projectile launchers, and more specifically to an easily removable stock for a projectile launcher using a pressurized propellant.

BACKGROUND

Stocks for projectile launchers for frangible projectiles are well known in the art. While such stocks according to the prior art provide a number of advantages, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY

According to one embodiment, the disclosed subject technology relates to a quick release stock assembly for a launcher using a pressurized propellant, wherein the quick release stock assembly comprises a stock bar and a stock housing.

The disclosed subject technology further relates to a quick release stock assembly for a launcher having an opening in a stock plate, the quick release stock assembly comprising: a two-part stock bar comprising a first stock bar member and a second stock bar member; the first stock bar member having a first end and a second end, the first end having a first mating member, the first mating member capable of passing through the opening in the stock plate when the first mating member is orientated in a first orientation, the first mating member being retained by the stock plate and precluded from removal from the launcher when the first mating member is orientated in a second orientation; the second stock bar member having a first end and a second end, the first end having a receiver that removably connects to the second end of the first mating member, and the second end of the second stock bar member having a plurality of apertures; a two-part stock housing comprising a stock tube and a stock base; the stock tube having a housing defining a cavity to receive a pressurized canister, the housing having a longitudinal opening adjacent the cavity, the opening having longitudinal grooves extending therein; the stock base having a top end that fits within the opening in the stock tube, the top end having ribs that engage the grooves to removably secure the stock base to the stock tube, the stock base having an aperture extending transverse to the top end, and the stock base further having a longitudinal receiver in the top end to receive the stock bar; and, a spring biased retaining pin residing in the aperture in the stock base, the retaining pin being biased toward the cavity in the stock tube, the retaining pin selectively engaging the plurality of apertures in the second stock bar member when the second stock bar member is inserted into the longitudinal receiver to engage the second stock bar member and longitudinally fix the second stock bar member in the stock housing.

The disclosed subject technology further relates to a quick release stock assembly for a launcher, comprising: a two-part stock bar comprising a first stock bar member and a second stock bar member, the first stock bar member having a mating member that secures the first stock bar member to the launcher in a first position, the first stock bar member being removable from the launcher in a second position of the first stock bar member, the second stock bar member being releasably secured to the first stock bar member, the second stock bar member further having a plurality of apertures there through; and, a stock housing having a cavity sized to receive a pressurized canister, the stock housing having a receiver to slidingly receive the second stock bar member about a length of the second stock bar member, the stock housing further having a release pin transverse to the receiver to engage the second stock bar member and longitudinally fix the second stock bar member in the stock housing in a plurality of positions.

The disclosed subject technology further relates to a quick release stock assembly for a launcher, comprising: an elongated stock bar having a first end and a second end, the first end having a mating member that secures the stock bar member to the launcher in a first orientation of the stock bar and which precludes the stock bar from being removed from the launcher when the stock bar is in the first orientation, the stock bar being removable from the launcher in a second orientation of the stock bar, the second end of the stock bar having a plurality of apertures there through; and, a stock housing having a cavity sized to receive a pressurized canister, the stock housing having a receiver to slidingly receive the stock bar about a length of the stock bar, the stock housing further having a release pin transverse to the receiver to engage the stock bar and longitudinally fix the stock bar in the stock housing in a plurality of positions.

The disclosed subject technology further relates to a quick release stock assembly wherein the first mating member of the first stock bar member is a t-bar mechanism.

The disclosed subject technology further relates to a quick release stock assembly wherein the mating member of the first stock bar member comprises a t-bar mechanism, the t-bar mechanism allowing the first stock bar to be removable from the launcher in a first orientation of the first stock bar member, and the t-bar mechanism precluding the first stock bar from being removed from the launcher in a second orientation of the first stock bar member.

The disclosed subject technology further relates to a quick release stock assembly wherein the mating member of the stock bar comprises a t-bar mechanism, and wherein the launcher has an opening that receives the t-bar mechanism when the t-bar mechanism is orientated in the second orientation but not in the first orientation.

The disclosed subject technology further relates to a quick release stock assembly wherein the first orientation of the first stock bar member is positioned approximately 90° from the second orientation of the first stock bar member.

The disclosed subject technology further relates to a quick release stock assembly wherein the first orientation of the stock bar is approximately 90° rotated from the second orientation of the stock bar.

The disclosed subject technology further relates to a quick release stock assembly wherein the second stock bar member has a receiver that removably connects the second stock bar member to a second end of the first stock bar member.

The disclosed subject technology further relates to a quick release stock assembly wherein the receiver of the second stock bar member is a clevis.

The disclosed subject technology further relates to a quick release stock assembly wherein the receiver comprises a clevis and a pin, and wherein an aperture is provided in the second end of the first stock bar member.

The disclosed subject technology further relates to a quick release stock assembly wherein the second stock bar member is positioned in a first plane, and wherein the first mating member is positioned in a second plane that is offset from the first plane.

The disclosed subject technology further relates to a quick release stock assembly wherein the second stock bar member is positioned in a first plane, and wherein the mating member of the first stock bar that secures the first stock bar member to the launcher is offset from the first plane.

The disclosed subject technology further relates to a quick release stock assembly wherein the second end of the stock bar is positioned in a first plane, and wherein the mating member of the stock bar that secures the stock bar to the launcher is offset from the first plane.

The disclosed subject technology further relates to a quick release stock assembly wherein the receiver in the stock housing for removably receiving the second stock bar member comprises a slot in the stock housing, the slot having an aperture to allow the release pin to engage the second stock bar member.

The disclosed subject technology further relates to a quick release stock assembly wherein the stock base is fixedly secured to the stock tube with fixing members after the stock base is received in the opening of the stock tube.

The disclosed subject technology further relates to a quick release stock assembly wherein the stock bar comprises a first stock bar member and a second stock bar member, the first stock bar member having a first end and a second end, the first end having the mating member, the second stock bar member having a first end and a second end, the first end of the second stock bar member having a receiver to releasably secure the first end of the second stock bar member to the second end of the first stock bar member, the plurality of apertures in the stock bar being provided adjacent the second end of the second stock bar member.

The disclosed subject technology further relates to a quick release stock assembly wherein the stock housing comprises a stock tube and a stock base, the stock tube defining the cavity to receive the pressurized canister, the stock tube having a longitudinal opening adjacent the cavity, the opening having longitudinal grooves extending therein, the stock base having a top end that fits within the opening in the stock tube, the top end having ribs that engage the grooves to secure the stock base to the stock tube.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example, with reference to the accompanying drawings in which embodiments of the disclosures are illustrated and, together with the descriptions below, serve to explain the principles of the disclosure.

DETAILED DESCRIPTION

Figure 1:
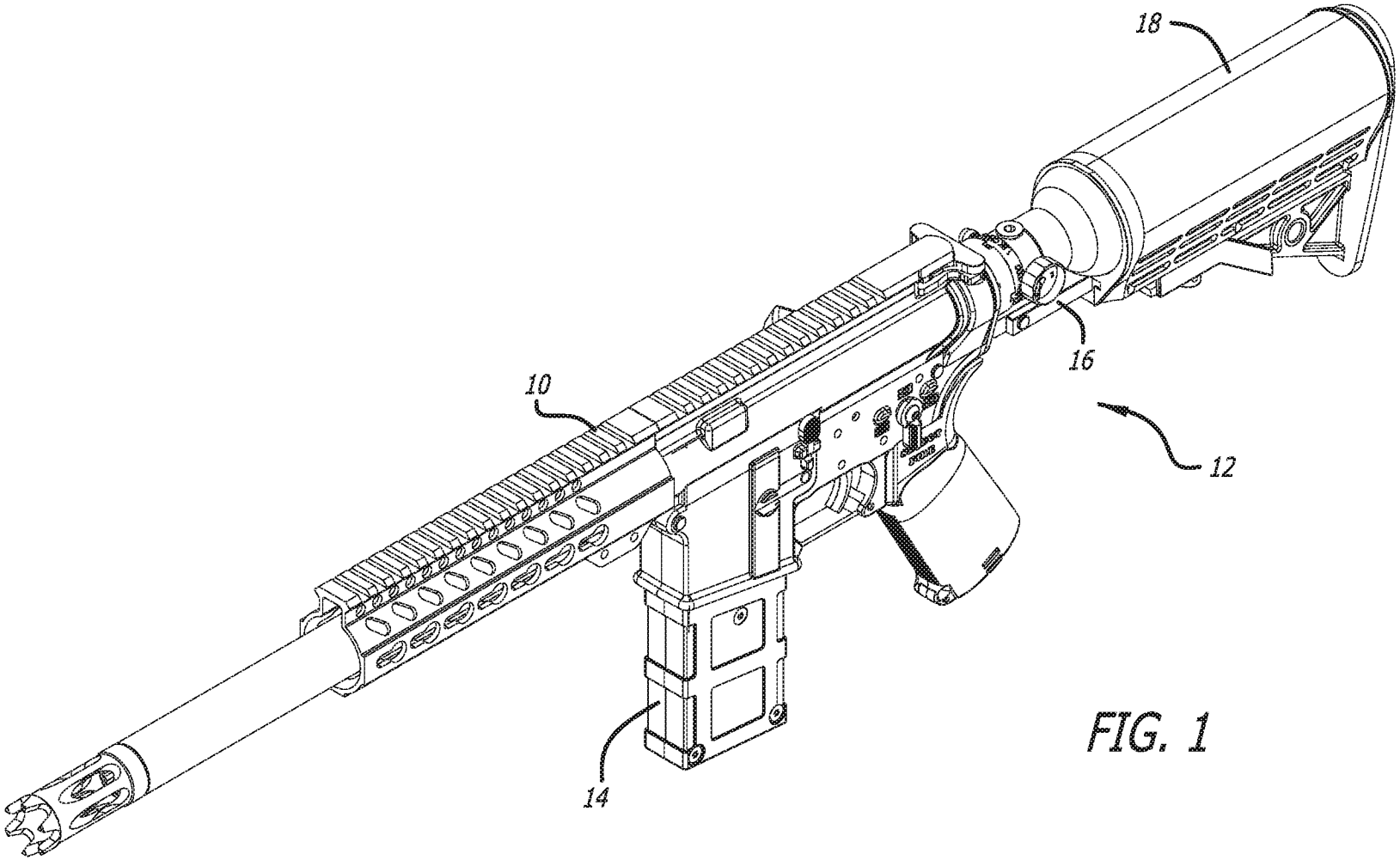
FIG. 1 is a perspective view of a frangible projectile launcher having a quick-release stock according to one embodiment.

While the stock for the projectile launcher discussed herein is susceptible of embodiments in many different forms, there is shown in the drawings, and will herein be described in detail, preferred embodiments with the understanding that the present description is to be considered as an exemplification of the principles of the stock for a projectile launcher and is not intended to limit the broad aspects of the disclosure to the embodiments illustrated.

Figure 2:
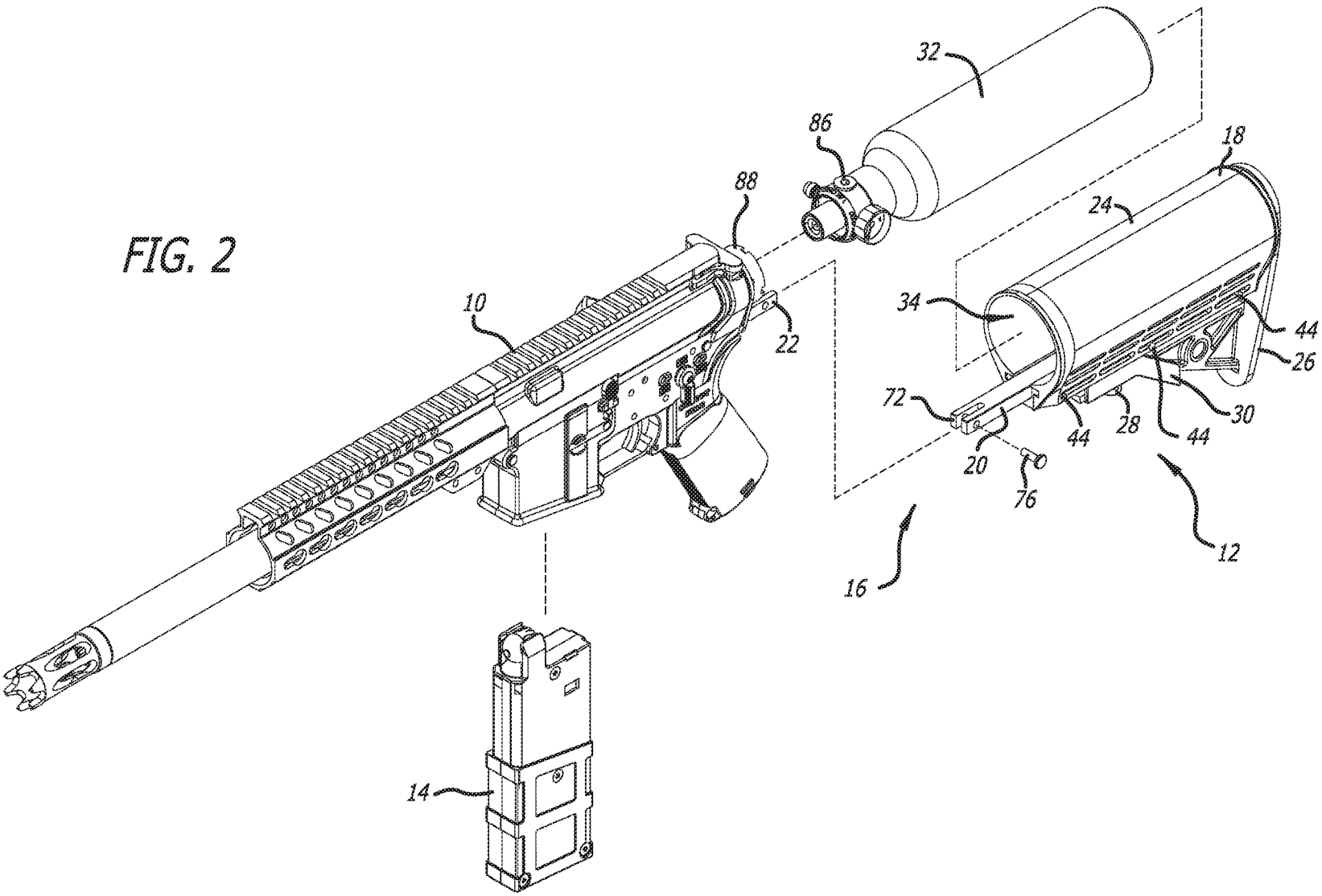
FIG. 2 is a partial exploded front perspective view of the frangible projectile launcher having a quick-release stock of FIG. 1.

Referring now to the figures, and initially to FIGS. 1 and 2, there is shown various embodiments of a launcher 10 for a frangible projectile where the launcher 10 includes a quick-release stock assembly 12. The launcher 10 utilizes compressed or high pressure gas to provide the propellant to accelerate a bolt (not shown) within the launcher 10 to fire a frangible projectile from the launcher 10. The launcher 10 may include a magazine 14 to hold the projectiles.

Referring to FIGS. 2-7, in one embodiment, the quick-release stock assembly 12 comprises a stock bar 16 and a stock housing 18. Further, in one embodiment, the stock bar 16 comprises a rear stock bar 20 and a stock bar neck 22 that is removably connected to the rear stock bar 20. The stock bar neck 22 is also referred to herein as the first stock bar member 22, and the rear stock bar 20 is also referred to herein as the second stock bar member 20. And, in one embodiment, the stock housing 18 comprises a stock tube 24, a stock base 26, a retaining pin 28, and an adjustment bar 30. Generally, the stock assembly is a part of a longer gun, such as rifle, to which the barreled action and firing mechanism are attached and which is typically held against the user's shoulder when shooting the gun. The stock provides a means for the shooter to firmly support the device and easily aim with stability. The stock may also transmit recoil, if any, into the shooter's body.

Figure 3:
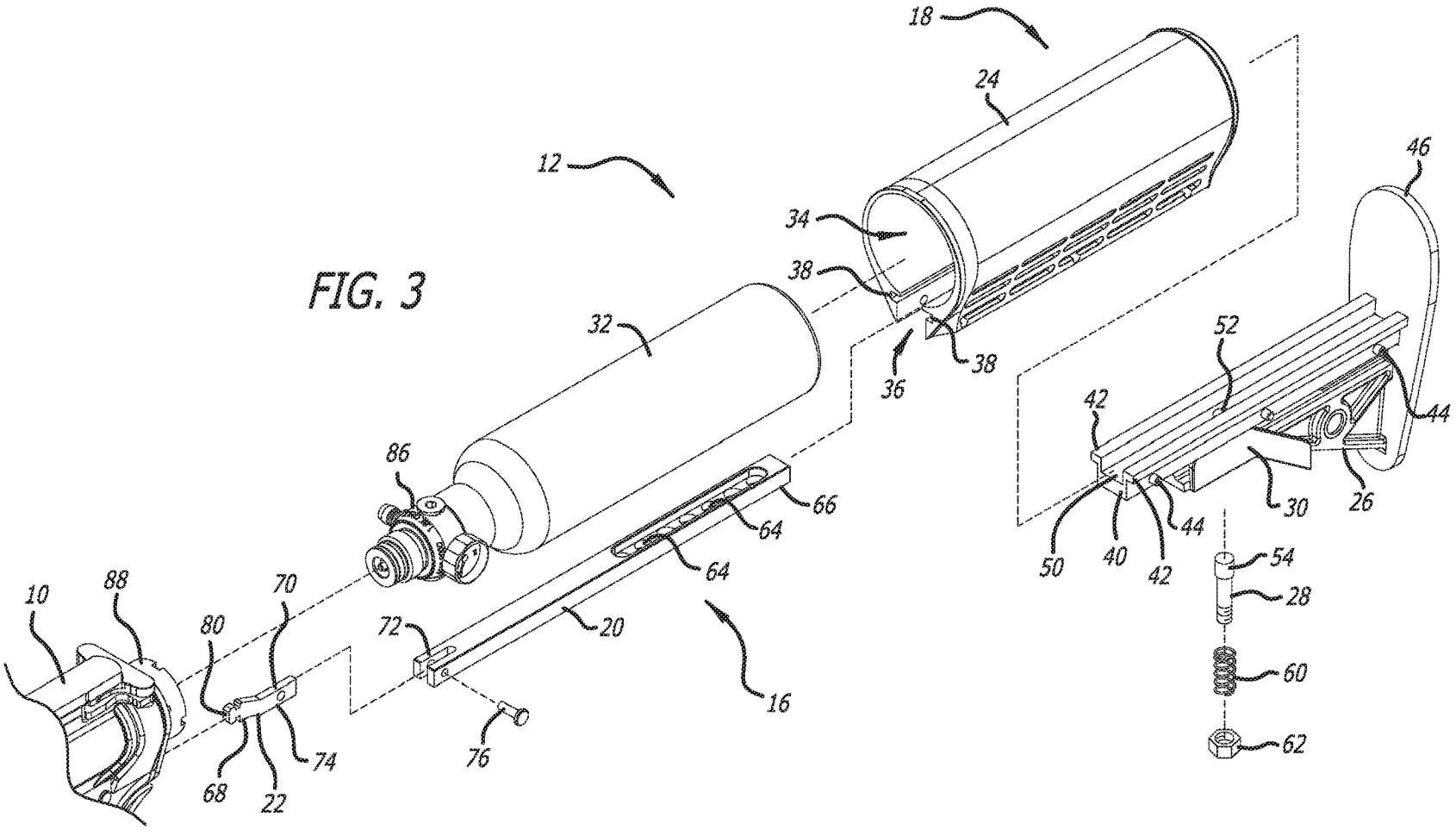
FIG. 3 is a partial exploded front perspective view of the quick-release stock of FIG. 1.
Figure 4:
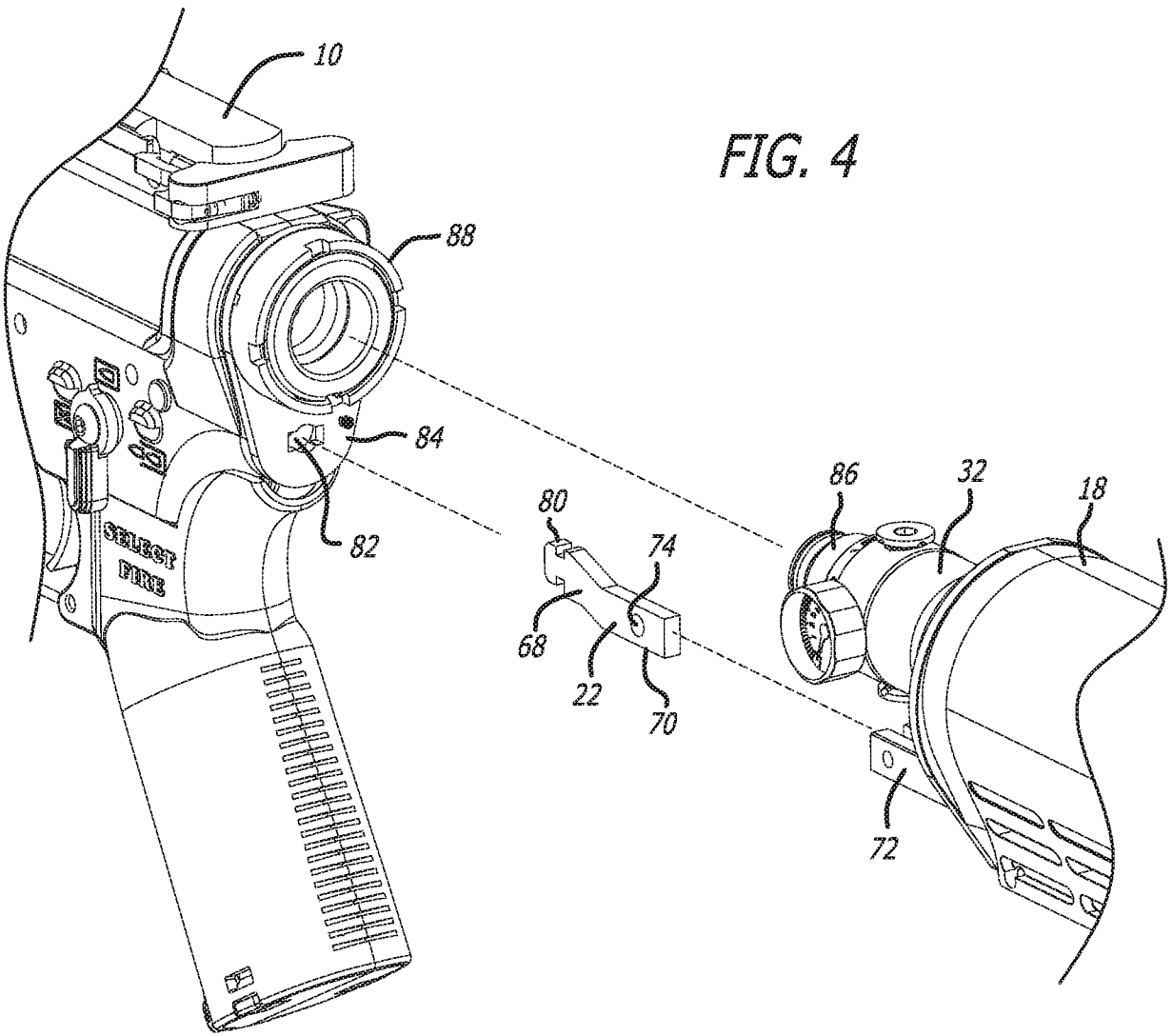
FIG. 4 is a partial exploded rear perspective view of the quick-release stock of FIG. 1.

In one embodiment, the stock housing 18 also used to support a compressed air tank 32 that provides a propellant for the launcher 10. In one embodiment, a portion of the compressed air tank 32 is fitted inside a cavity 34 in the stock tube 24 of the stock housing 18, as shown in FIGS. 1 and 5-7. As shown in FIG. 3, the compressed air tank 32 is generally cylindrical in shape. In such an embodiment, the cavity 34 of the stock tube 24 of the stock housing 18 is similarly cylindrical in shape.

As shown in the figures, in one embodiment the stock base 26 is connected to the stock tube 24 to form the stock housing 18. Alternately, the stock base 26 may be an integral component with the stock tube 24. In one embodiment, the stock tube 24 has an opening 36 to receive the stock housing 18. As shown in FIG. 3, in one embodiment, the opening 36 is longitudinal in shape and may extend generally the entire length of the stock tube 24, however, a shorter or different shape opening 36 may be utilized. Additionally, in one embodiment there are longitudinal grooves 38 that extend into the opening 36 of the stock tube 24.

A top end 40 of the stock base 26 is shaped to fit in the opening 36 of the stock tube 24 and also to fit within the grooves 38 in the opening 36 to connect the stock base 26 to the stock tube 24. In one embodiment, the top of the stock base 26 has a channel or U-shape 40 that fits within the opening 36 in the stock tube 24, and the u-shaped top 40 has transverse longitudinal members 42 extending therefrom that operate as ribs 42 to engage the grooves 38. Therefore, to connect the stock base 26 to the stock tube 24, the channel shape 40 at the top of the stock base 26 is lined up with the opening 36 and the ribs 42 are lined up with the grooves 38 in the opening, and then the stock base 26 is slide into the opening 36 in the stock tube 24 to seat the stock base 26 on the stock tube 24. Accordingly, in one embodiment, the stock base 26 slidingly engages the stock tube 24. Once the stock base 26 is properly placed into the opening 36, the stock base 26 is preferably fixed in place to the stock tube 24. In one embodiment three pins 44 are used to fix the stock base 26 to the stock tube 24. Additionally, as shown in FIG. 3, in one embodiment the stock base 26 has an extension 46 that forms an endcap 48 for the stock tube 24.

As shown in FIG. 3, the U-shaped 40 top end 40 of the stock base 26 has a slot 50. The slot 50 operates as a receiver 50 for the rear stock bar 20 of the stock bar 16 to mate with and seat the stock bar 20 in the stock housing 18. In one embodiment the receiver 50 slidingly receives the stock bar 16.

In one embodiment, the stock base 26 has an aperture 52 to receive the retaining pin 28. In one embodiment the retaining pin 28, also called a release pin 28 or selector pin 28, is spring loaded. The retaining pin 28 is used to longitudinally or axially retain the stock bar 16 in place in the slot 50 of the stock base 26. In one embodiment, the retaining pin 28 has an enlarged head 54. And, the aperture 52 preferably has a first bore 56 and a second bore 58. The first bore 56 is a through hole, and the second bore 58 is a countersink of a larger diameter than the first bore 56. A compression spring 60 is provided in the second bore 58 and is retained between the end of the second bore 58 and the enlarged head 54 of the retaining pin 28. The spring 60 operates to bias the retaining pin 28 toward to the stock bar 16. A cap 62 is connected to the opposing end of the retaining pin 28 to secure the retaining pin 28 in the aperture 52. The cap 62 is preferably connected to the retaining pin 28 on the outside of the adjustment bar 30. Accordingly, since the adjustment bar 30 has a lever portion, when the lever portion is squeezed toward the stock base 26, the adjustment bar 30 will operate to pull the retaining pin 28 downwardly, thereby removing the retaining pin 28 from engagement with the stock bar 16, and thus allowing the stock bar 16 to slide in the receiver 50.

Figure 5:
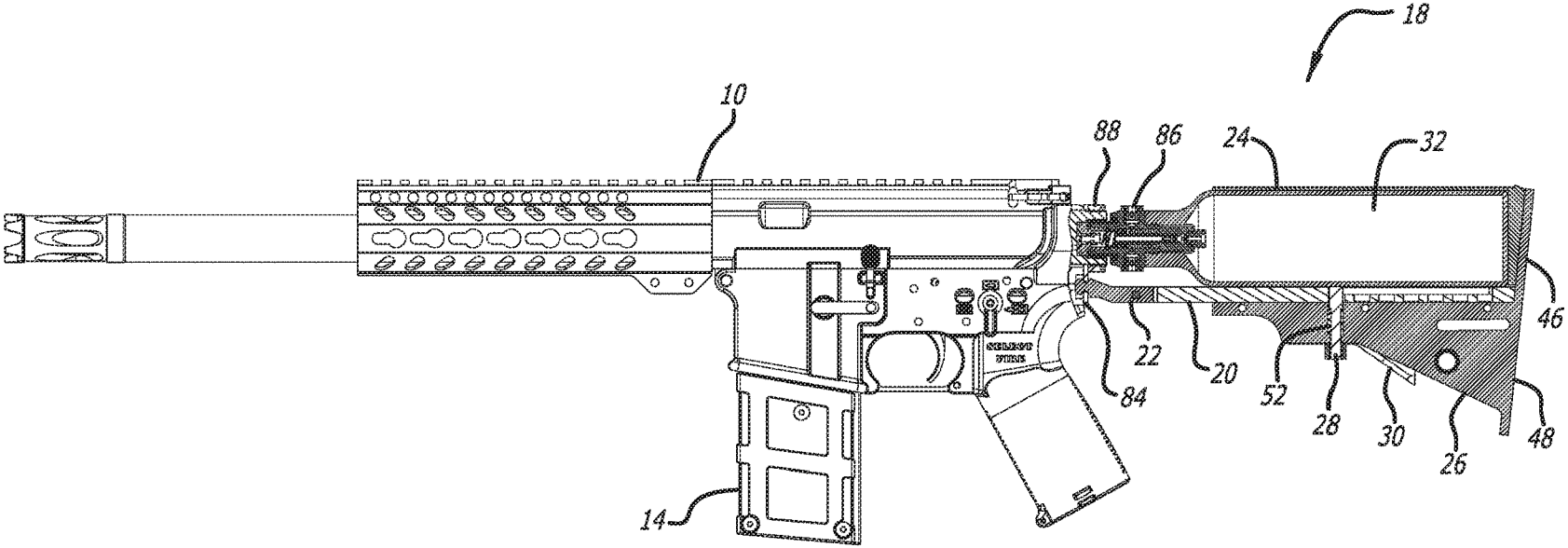
FIG. 5 is a side view of the frangible projectile launcher having a quick-release stock of FIG. 1
Figure 6:
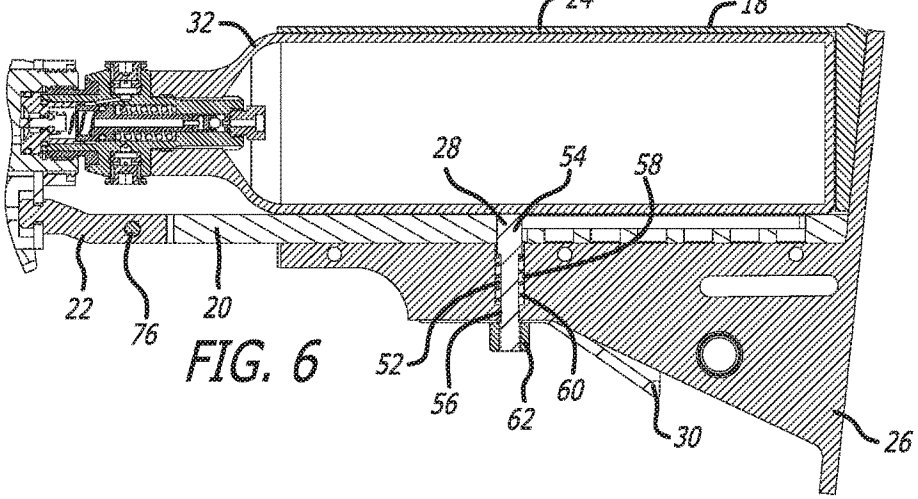
FIG. 6 is a cross-sectional side view of a portion of the frangible projectile launcher and quick-release stock of FIG. 1.
Figure 7:
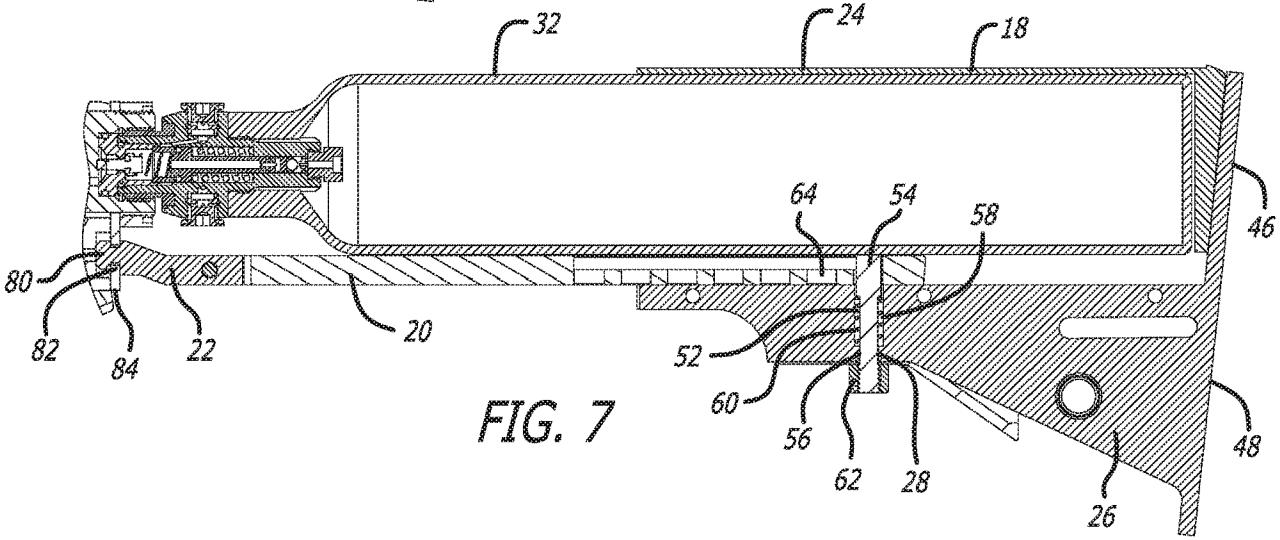
FIG. 7 is a cross-sectional side view of a portion of the frangible projectile launcher and quick-release stock of FIG. 1, with the stock housing in an extended position.

As best shown in FIG. 3, but also shown in FIGS. 5-7 in cross section, the rear stock bar 20 has a plurality of apertures 64 extending about a length of the rear stock bar 20 toward the distal end 66 thereof. The apertures 64 are engageable by the enlarged head 54 of the retaining pin 28. By pulling the retaining pin 28 downwardly and sliding the stock bar 20 in and out of the slot 50, the stock housing 18 is moved toward and away from the gun 10. This provides for two functions. First, it allows for the stock housing 18 to adjust to different length compresses air tanks 32, but more importantly, it allows for the stock housing 18 to be moved for proper fitting/sizing with the operator such that the launcher 10 with the stock assembly 12 fits properly against the user's shoulder.

As explained herein, the stock bar 16 preferably comprises the rear stock bar 20 that is fitted into the slot or opening 50 in the stock housing, as well as the stock bar neck 22. The stock bar neck 22 operates to connect the stock bar 16 to the launcher 10. The stock bar neck 16 has a first end 68 and a second end 70. The first end 68 of the stock bar neck 16 is used to connect the stock bar neck 16 to the launcher 10, and the second end 70 of the stock bar neck 16 connects the stock bar neck 16 to the rear stock bar 20. In one embodiment, the second stock bar member is positioned in a first plane, and the first mating member of the first stock bar member is positioned in a second plane that is offset from the first plane.

In one embodiment, the proximal or first end of the rear stock bar 20 has a receiver 72, which in one embodiment is a clevis 72, and a second or distal end 70 of the stock bar neck 16 has an aperture 74. The receiver 72 of the rear stock bar 20 removably connects to the second end of the stock bar neck 16. A pin 76 extends through the openings in the clevis 72 of the rear stock bar 20 as well as through the aperture 74 in the stock bar neck 22 to join the stock bar neck 16 to the rear stock bar 20.

Further, in one embodiment, to connect the stock bar 16 to the launcher 10, the first end 68 of the stock bar neck 16 has a first mating member 80 and the launcher 10 has a second mating member 82. In one embodiment the first mating member 80 comprises a T-bar mechanism 80. And, in one embodiment the second mating member 82 comprises a slot or opening 82 in the rear plate 84, also referred to as the stock plate 84, of the launcher 10. The t-bar mechanism 80 is slid through the slot 82 and then rotated 90° to lock the t-bar 80 to the stock plate 84. Accordingly, the first mating member is capable of passing through the opening in the stock plate when the first mating member is orientated in a first orientation or first position. The first mating member is retained by the stock plate and precluded from removal from the launcher when the first mating member is orientated in the second orientation or second position.

As shown in the figures, the compresses air tank 32 that retains the pressurized propellant preferably has a valve 86 and is connected to the rear of the launcher 10. A lock ring 88 secures the air tank 32 to the launcher 10.

Accordingly, to connect the quick-release stock assembly 12 to the launcher 10, the stock bar neck 16 is first connected to the stock plate 84 of the launcher 10 by inserting the t-bar 80 end of the stock bar neck 16 through the slot 82 in the stock plate 84 and then rotating the stock bar neck 16 by 90° to lock the stock bar neck 16 to the stock plate 84. Next, the rear stock bar 20 is connected to the stock bar neck 16 with pin 76. The rear stock bar 20 is then slid into the slot 50 the stock housing 18 and the stock tube 24 is fitted around the air tank 32. The rear stock bar 20 is slid sufficiently into the slot 50 in the stock housing 18 an appropriate length such that the stock assembly 12 properly fits the user. When the rear stock bar 20 is being slid into the slot 50 of the stock housing 18, the user must depress the adjustment bar 30 so that the release pin 28 is pulled against the bias spring to prevent the release pin 28 from contacting the rear stock bar 20 and thereby allowing the rear stock bar 20 to slide without restriction. When the rear stock bar 20 and stock housing 18 are in the appropriate relative location the adjustment bar 30 and release pin 28 can be released and the release pin 28 will engage the appropriate aperture 64 in the stock bar 16 to longitudinally lock the stock bar 16 to the stock housing 18. To remove the stock assembly, the stock bar neck 16 is rotated 90° so that the t-bar 80 is aligned with the slot 82 in the stock plate 84, at which time the stock bar 16 can be removed from the launcher body.

In an alternate embodiment shown in U.S. Patent Application No. 62/446,748, the stock bar has an insertion post that has an annular groove as well as a transverse flat portion. Further, the body of the launcher has an aperture for receiving the post, and a pin that passes through a portion of the aperture in a transverse manner. To lock the stock bar to the launcher body, the post is inserted into the aperture and the flat portion of the post is aligned with the pin to allow the post to partially pass by the pin. To lock the stock to the launcher body the stock bar is rotated approximately 45° degrees whereby the pin will engage the annular groove to lock the stock in the aperture. To remove the stock, the stock must be rotated so that the flat is aligned with the pin, at which time the stock can be taken out of the aperture in the launcher body.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

What is claimed is:

1. A quick release stock assembly for a launcher having an opening in a stock plate, the quick release stock assembly comprising:

a two-part stock bar comprising a first stock bar member and a second stock bar member;

the first stock bar member having a first end and a second end, the first end having a first mating member, the first mating member capable of passing through the opening in the stock plate when the first mating member is orientated in a first orientation, the first mating member being retained by the stock plate and precluded from removal from the launcher when the first mating member is orientated in a second orientation;

the second stock bar member having a first end and a second end, the first end having a receiver that removably connects to the second end of the first mating member, and the second end of the second stock bar member having a plurality of apertures;

a two-part stock housing comprising a stock tube and a stock base;

the stock tube having a housing defining a cavity to receive a pressurized canister, the housing having a longitudinal opening adjacent the cavity, the opening having longitudinal grooves extending therein;

the stock base having a top end that fits within the opening in the stock tube, the top end having ribs that engage the grooves to removably secure the stock base to the stock tube, the stock base having an aperture extending transverse to the top end, and the stock base further having a longitudinal receiver in the top end to receive the stock bar; and, a spring biased retaining pin residing in the aperture in the stock base, the retaining pin being biased toward the cavity in the stock tube, the retaining pin selectively engaging the plurality of apertures in the second stock bar member when the second stock bar member is inserted into the longitudinal receiver to engage the second stock bar member and longitudinally fix the second stock bar member in the stock housing.

2. The quick release stock assembly of claim 1, wherein the first mating member of the first stock bar member is a t-bar mechanism.

3. The quick release stock assembly of claim 1, wherein the first orientation of the first stock bar member is positioned approximately 90° from the second orientation of the first stock bar member.

4. The quick release stock assembly of claim 1, wherein the receiver of the second stock bar member is a clevis.

5. The quick release stock assembly of claim 1, wherein the second stock bar member is positioned in a first plane, and wherein the first mating member is positioned in a second plane that is offset from the first plane.

6. The quick release stock assembly of claim 1, wherein the stock base is further fixedly secured to the stock tube with fixing members after the stock base is received in the opening of the stock tube.

7. A quick release stock assembly for a launcher, comprising:

a two-part stock bar comprising a first stock bar member and a second stock bar member, the first stock bar member having a mating member that secures the first stock bar member to the launcher in a first position, the first stock bar member being removable from the launcher in a second position of the first stock bar member, the second stock bar member being releasably secured to the first stock bar member, the second stock bar member further having a plurality of apertures there through; and, a stock housing having a cavity sized to receive a pressurized canister, the stock housing having a receiver to slidingly receive the second stock bar member about a length of the second stock bar member, the stock housing further having a release pin transverse to the receiver to engage the second stock bar member and longitudinally fix the second stock bar member in the stock housing in a plurality of positions.

8. The quick release stock assembly of claim 7, wherein the mating member of the first stock bar member comprises a t-bar mechanism, the t-bar mechanism allowing the first stock bar to be removable from the launcher in a first orientation of the first stock bar member, and the t-bar mechanism precluding the first stock bar from being removed from the launcher in a second orientation of the first stock bar member.

9. The quick release stock assembly of claim 7, wherein the first position of the first stock bar member is approximately 90° rotated from the second position of the first stock bar member.

10. The quick release stock assembly of claim 7, wherein the second stock bar member has a receiver that removably connects the second stock bar member to a second end of the first stock bar member.

11. The quick release stock assembly of claim 10, wherein the receiver comprises a clevis and a pin, and wherein an aperture is provided in the second end of the first stock bar member.

12. The quick release stock assembly of claim 7, wherein the receiver in the stock housing for removably receiving the second stock bar member comprises a slot in the stock housing, the slot having an aperture to allow the release pin to engage the second stock bar member.

13. The quick release stock assembly of claim 7, wherein the stock housing comprises a stock tube and a stock base, the stock tube defining the cavity to receive the pressurized canister, the stock tube having a longitudinal opening adjacent the cavity, the opening having longitudinal grooves extending therein, the stock base having a top end that fits within the opening in the stock tube, the top end having ribs that engage the grooves to secure the stock base to the stock tube.

14. The quick release stock assembly of claim 7, wherein the second stock bar member is positioned in a first plane, and wherein the mating member of the first stock bar that secures the first stock bar member to the launcher is offset from the first plane.

15. A quick release stock assembly for a launcher, comprising:

an elongated stock bar having a first end and a second end, the first end having a mating member that secures the stock bar member to the launcher in a first orientation of the stock bar and which precludes the stock bar from being removed from the launcher when the stock bar is in the first orientation, the stock bar being removable from the launcher in a second orientation of the stock bar, the second end of the stock bar having a plurality of apertures there through; and, a stock housing having a cavity sized to receive a pressurized canister, the stock housing having a receiver to slidingly receive the stock bar about a length of the stock bar, the stock housing further having a release pin transverse to the receiver to engage the stock bar and longitudinally fix the stock bar in the stock housing in a plurality of positions.

16. The quick release stock assembly of claim 15, wherein the stock bar comprises a first stock bar member and a second stock bar member, the first stock bar member having a first end and a second end, the first end having the mating member, the second stock bar member having a first end and a second end, the first end of the second stock bar member having a receiver to releasably secure the first end of the second stock bar member to the second end of the first stock bar member, the plurality of apertures in the stock bar being provided adjacent the second end of the second stock bar member.

17. The quick release stock assembly of claim 15, wherein the mating member of the stock bar comprises a t-bar mechanism, and wherein the launcher has an opening that receives the t-bar mechanism when the t-bar mechanism is orientated in the second orientation but not in the first orientation.

18. The quick release stock assembly of claim 15, wherein the second end of the stock bar is positioned in a first plane, and wherein the mating member of the stock bar that secures the stock bar to the launcher is offset from the first plane.

19. The quick release stock assembly of claim 15, wherein the first orientation of the stock bar is approximately 90° rotated from the second orientation of the stock bar.

20. The quick release stock assembly of claim 15, wherein the stock housing comprises a stock tube and a stock base, the stock tube defining the cavity to receive the pressurized canister, the stock tube having a longitudinal opening adjacent the cavity, the opening having longitudinal grooves extending therein, the stock base having a top end that fits within the opening in the stock tube, the top end having ribs that engage the grooves to secure the stock base to the stock tube.

* * * * *